US006346691B2

(12) United States Patent
Kim et al.

(10) Patent No.: US 6,346,691 B2
(45) Date of Patent: Feb. 12, 2002

(54) CONVECTION FAN CONTROL METHOD OF MICROWAVE OVEN

(75) Inventors: Joo Yong Kim; Sang Ki Lee; Dae Sik Kim, all of Changwon (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/732,400

(22) Filed: Dec. 7, 2000

(30) Foreign Application Priority Data

Dec. 11, 1999 (KR) ..... 99-56962

(51) Int. Cl.[7] ..... H05B 6/68

(52) U.S. Cl. ..... 219/681; 219/757; 219/400; 126/21 A

(58) Field of Search ..... 219/681, 757, 219/702, 400, 401; 99/DIG. 14, 451, 325; 126/21 A

(56) References Cited

U.S. PATENT DOCUMENTS 4,467,777 A * 8/1984 Weber ..... 126/21 A

FOREIGN PATENT DOCUMENTS

| | | | |
|---|---|---|---|
| JP | 56-77631 | * | 6/1981 |
| JP | 4-139314 | * | 5/1992 |
| JP | 4-190017 | * | 7/1992 |
| JP | 9-126462 | * | 5/1997 |

* cited by examiner

*Primary Examiner*—Philip H. Leung
(74) *Attorney, Agent, or Firm*—Ostrolenk, Faber, Gerb & Soffen, LLP

(57) ABSTRACT

The present invention relates to a convection fan control method of a microwave oven which is capable of changing discharge direction of the air heated by a heater to a heating object by controlling rotation direction of a convection fan in accordance with types of a dish comprising a cooking time setting process for selecting a dish type of a heating object and setting cooking time, a rotation direction setting process for setting rotating direction of a fan motor which is capable of rotating and reverse-rotating, a fan motor operating process for operating the fan motor in accordance with the set rotating direction, a fan operating process for rotating a fan by the operating of the fan motor, and a cooking process for cooking the heating object for the select cooking time by operating of a heater.

10 Claims, 4 Drawing Sheets

CONVECTION FAN CONTROL METHOD OF MICROWAVE OVEN

BACKGROUND OF THE INVENTION

1. Field of the Invention

The present invention relates to a convection fan control method of a microwave oven, in particular to a convention fan control method of microwave oven which is capable of altering discharge direction of the air heated by a heater to a heating object by controlling the rotation direction of a convection fan in accordance with type of dish.

2. Description of the Prior Art

The general microwave oven heats a heating object (food) by using microwave generated from a magnetron.

Recently, besides the magnetron, other heating method is added to the microwave oven in order to provide various functions.

Among them, there is a method which heats the heating object by installing an additional heater and using the heat generated from the additional heater.

As depicted in FIG. 1, in a microwave oven comprising the heater as an additional heating source, a heater chamber 4 including heaters 6*a*, 6*b* is formed on the upper portion of a cavity 2 where the heating object is placed and is heated.

A fan 10 is installed on the inner middle portion of the heater chamber 4, the heaters 6*a*, 6*b* are installed on the both sides of the fan 10, and a motor M1 for rotating the fan 10 is installed on the outer side of the heater chamber above the fan 10.

Each blade 7 is installed on the left/right side of the fan 10 in order to generate air flow when the fan 10 rotates.

And, an air inlet hole 8 is formed on the middle upper surface of the cavity 2 corresponding to the bottom surface of the heater chamber 4, and each air outlet hole 9 is formed on the both sides of the air inlet hole 8 in order to circulate the air generated by the fan.

In more detail, the air inlet hole is formed on the direct lower portion of the fan 10 in order to suck inner air of the cavity 2, and the air outlet hole 9 is formed on the lower outer circumference portion of the fan 10 in order to provide the air sucked through the air inlet hole to the inner side of the cavity 2 by rotating of the fan 10.

The air inlet hole 8 and air outlet hole 9 are a plurality of air holes.

Hereinafter, the operation of the conventional microwave oven will now be described, in the conventional microwave oven, in order to heat the inside of the cavity 2 by using the heaters 6*a*, 6*b*, a power is applied to the heaters 6*a*, 6*b* in order to generate the heat, and at the same time the motor M1 is operated in order to operate the fan 10.

According to the operation of the fan 10, the air flowed from the inside of the cavity 2 toward the fan 10 through the air inlet hole 8 is discharged through the air outlet hole 9. Herein, the heat generated from the heaters 6*a*, 6*b* inside of the heater chamber 4 is applied to the inside of the cavity 2 through the air.

However, the conventional convection heater type microwave oven has some problems.

First, the air heated by the heaters 6*a*, 6*b* circulates inside of the cavity 2 through the air inlet hole 8 and air outlet hole formed on the bottom surface of the heater chamber 4.

In more detail, the air flowing toward the fan 10 installed on the heater chamber 4 is transferred to a radius direction of the blade 7 by the centrifugal force caused by the rotating of the fan 10 while flowing along the blade 7.

Accordingly, the air flows to the fan 10 through the air inlet hole 8 according to a decrease of pressure on the direct lower portion of the fan 10, the air is heat-exchanged with the heat generated by the heater 2, and the air heats the inside of the cavity 2 by being discharged into the cavity 2 through the air outlet hole 9.

In other words, in the conventional convection heater type microwave oven, the air circulating the inside of the cavity 2 flows through the air inlet hole 8 and air outlet hole 9 formed on the upper surface of the cavity 2. Accordingly, the heated air can contact to the heating object only after being heat-exchanged with the inner wall surface and the inner side surface area of the cavity 2.

Accordingly, it is not efficient to cook the heating object because the cooking temperature and cooking speed of the heating object are lowered.

SUMMARY OF THE INVENTION

The object of the present invention is to provide a convection fan control method of a microwave oven, in particular to a convention fan control method of a microwave oven which is capable of altering the discharge direction of the air heated by a heater to a heating object by controlling the rotation direction of a convection fan in accordance with the type of a dish.

In order to achieve above-mentioned problems, the convention fan control method of the microwave oven according to the present invention comprises a cooking time setting process for selecting a dish type of a heating object and setting cooking time, a rotation direction setting process for setting rotating direction of a fan motor which is capable of rotating and reverse-rotating, a fan motor operating process for operating the fan motor in accordance with the set rotating direction, a fan operating process for rotating a fan by the rotating of the fan motor, and a cooking process for cooking the heating object for the set cooking time by operating the heater.

DETAILED DESCRIPTION OF THE PREFERRED EMBODIMENT

Hereinafter, a convection fan control method of a microwave oven according to the present invention will now be described with reference to accompanying drawings.

A plurality of embodiments of the present invention can be, hereinafter the most advisable embodiment will now be described.

A convection motor M2 of the present invention can rotate both to direct direction and reverse direction.

Figure 1:
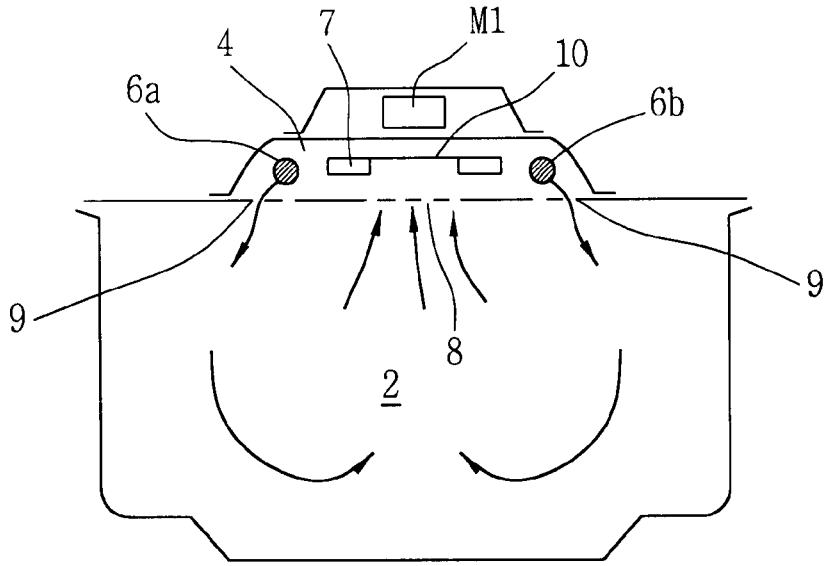
FIG. 1 BACKGROUND ART
FIG. 1 illustrates construction of the conventional microwave oven.
Figure 2:
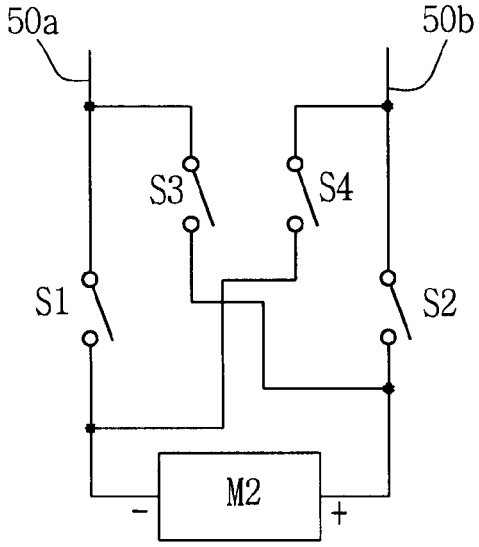
FIG. 2 illustrates construction of a convection fan motor operation unit of a microwave oven according to the present invention.

FIG.2 illustrates construction of a convection fan motor operation unit of a microwave oven according to the present invention. Th convection motor M2 of the present invention is installed between a first power line 50*a* and a second power line 50*b*.

In more detail, a switch S1 can be selectively connected to the first power line 50*a*, a switch S2 can be selectively connected to the second power line 50*b* so as to perform ON operation in the direct rotation, and at the same the switch S3 can be selectively connected to the first power line 50*a*, a switch S4 can be selectively connected to the second power line 50*b* so as to perform ON operation in the reverse rotation.

In other words, in order to rotate the motor M2, the switches S1, S2 are ON, the switch S3, S4 are OFF, and on the contrary in order to rotate the motor fan M2 to the reverse direction, the switches S3, S4 are ON, the switches S1, S2 are OFF.

Figure 3:
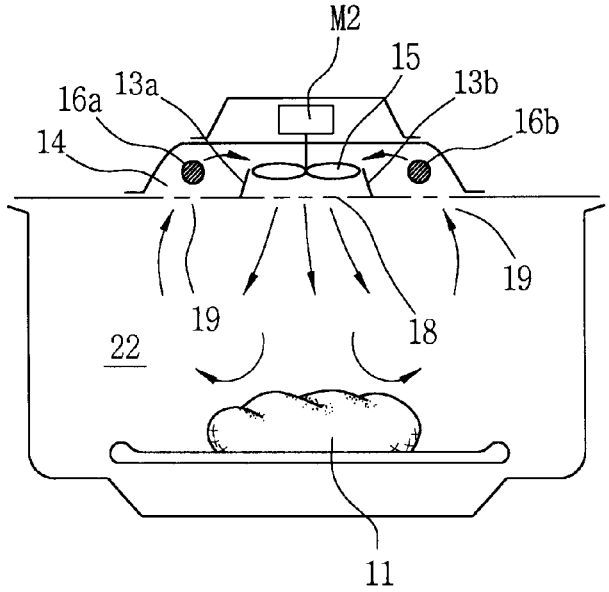
FIG. 3 is a sectional view illustrating air flow generated when a convection fan rotates.
Figure 4:
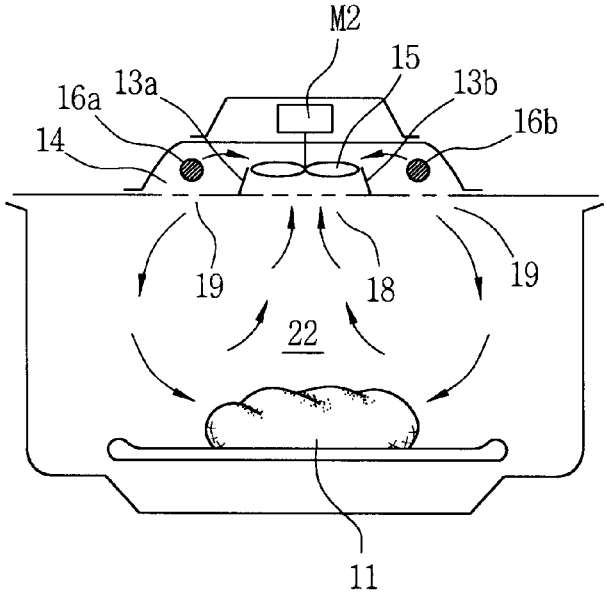
FIG. 4 is a sectional view illustrating air flow generated when the convection fan performs reverse-rotation.

Accordingly, as depicted in FIGS. 3 and 4, in the microwave oven of the present invention, a fan 15 can be rotated directly and reversely in accordance with the selective operation of the motor M2 installed on the middle of the microwave oven, accordingly an axial fan is used as the fan 15 in order to alter the air flow direction in the direct rotation and reverse rotation. And a DC motor or a stepping motor which is capable of controlling a rotating direction can be used as the motor M2.

And, heaters 16*a*, 16*b* are installed on a heater chamber 14 formed on the upper portion of a cavity 22, guides 13*a*, 13*b* are installed between the heaters 16*a*, 16*b* and fan 15, accordingly the air flow direction can be easily altered according to the rotation direction of the fan 15.

The heater chamber 14 and cavity 22 formed separately are combined so as to be ventilated by a plurality of air inlet holes for circulating the air inside of the cavity 22 and inside of the heater chamber 14.

In other words, when the fan 15 rotates to the direct direction, a first air outlet hole 18 placed on the direct lower portion of the fan 15 performs a function of an air discharge hole for discharging the high temperature air to the inside of the cavity 22.

At the same time, a second air outlet hole 19 formed on the outer circumference of the first air outlet hole 18 performs a function of an air inlet hole for making the air flow from inside of the cavity to the inside of the heater chamber 14.

Accordingly, when the fan 15 rotates to the direct direction, the air heated from the first air outlet hole 18 formed on the upper middle portion of the cavity 22 is directly provided to the heating object, accordingly the cooking can be performed with strong heat power.

Herein, the cooking speed is fast, but the lower portion of the heating object may not be heated sufficiently, and accordingly it is suitable for a dish required strong heat power in short time such as a baked fish.

On the contrary, when the fan 15 rotates in the reverse direction, the first outlet hole 18 placed on the direct lower portion of the fan 15 performs an air inlet hole function making the air flow from the inside of the cavity 22 toward the fan 15.

At the same time, the second air outlet hole 19 formed on the outer circumference of the first air outlet hole 18 performs a function of an air discharge hole discharging the heated air inside of the cavity 22.

In other words, the air heated from the second air outlet hole 19 is provided to the inside of the cavity 22 by the reverse rotation of the fan 15.

Accordingly, the heating object 11 can be evenly heated from the lower portion by the heated air flowed from the inner side portion of the cavity 22, but the cooking time is long.

Accordingly, it is advisable for a dish required even heating such as a baking.

Hereinafter, the control process of the convection fan of the microwave oven according to the present invention will now be described.

Figure 5:
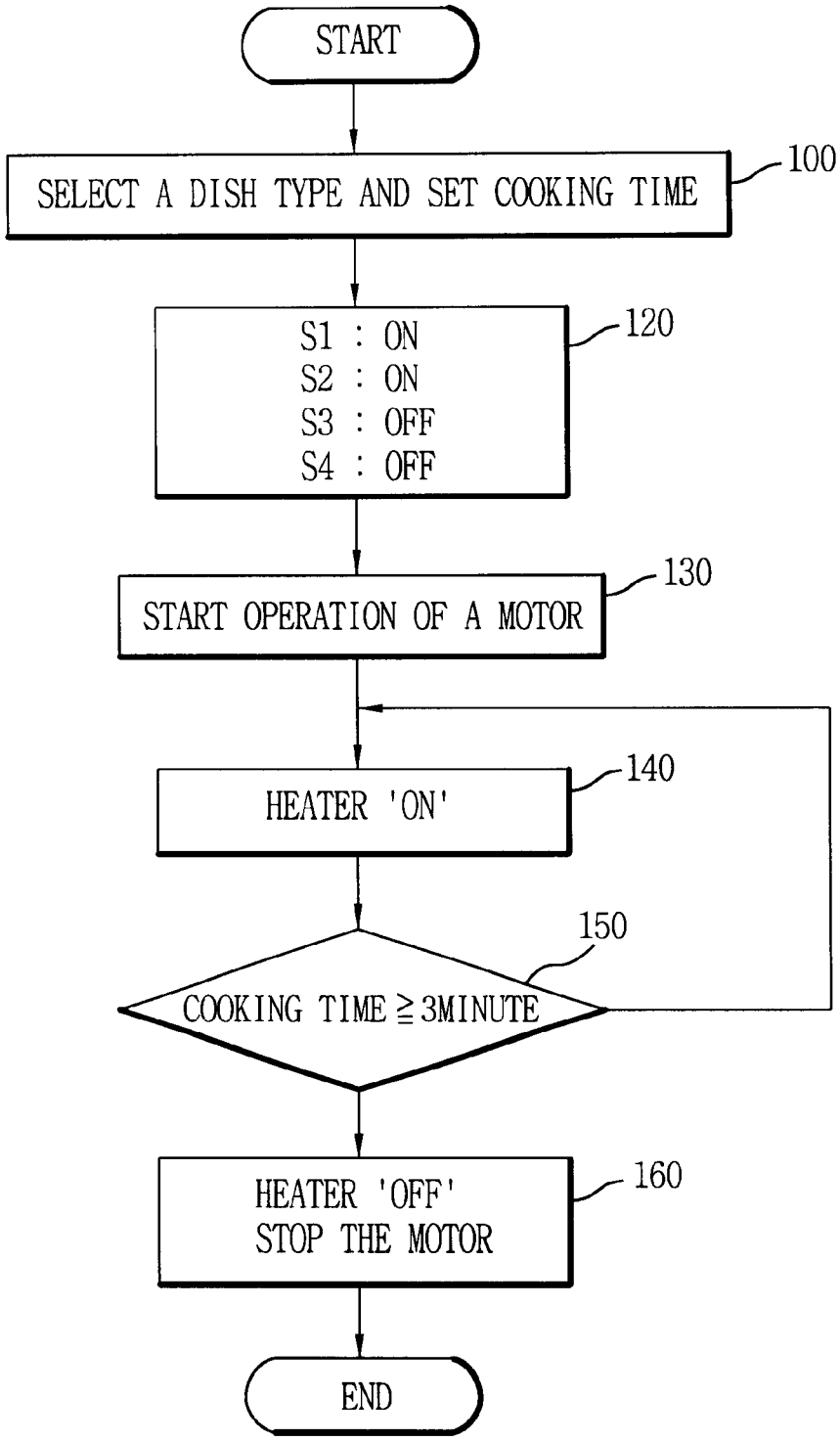
FIG. 5 is a flow chart illustrating the rotating convection fan control according to the present invention.
Figure 6:
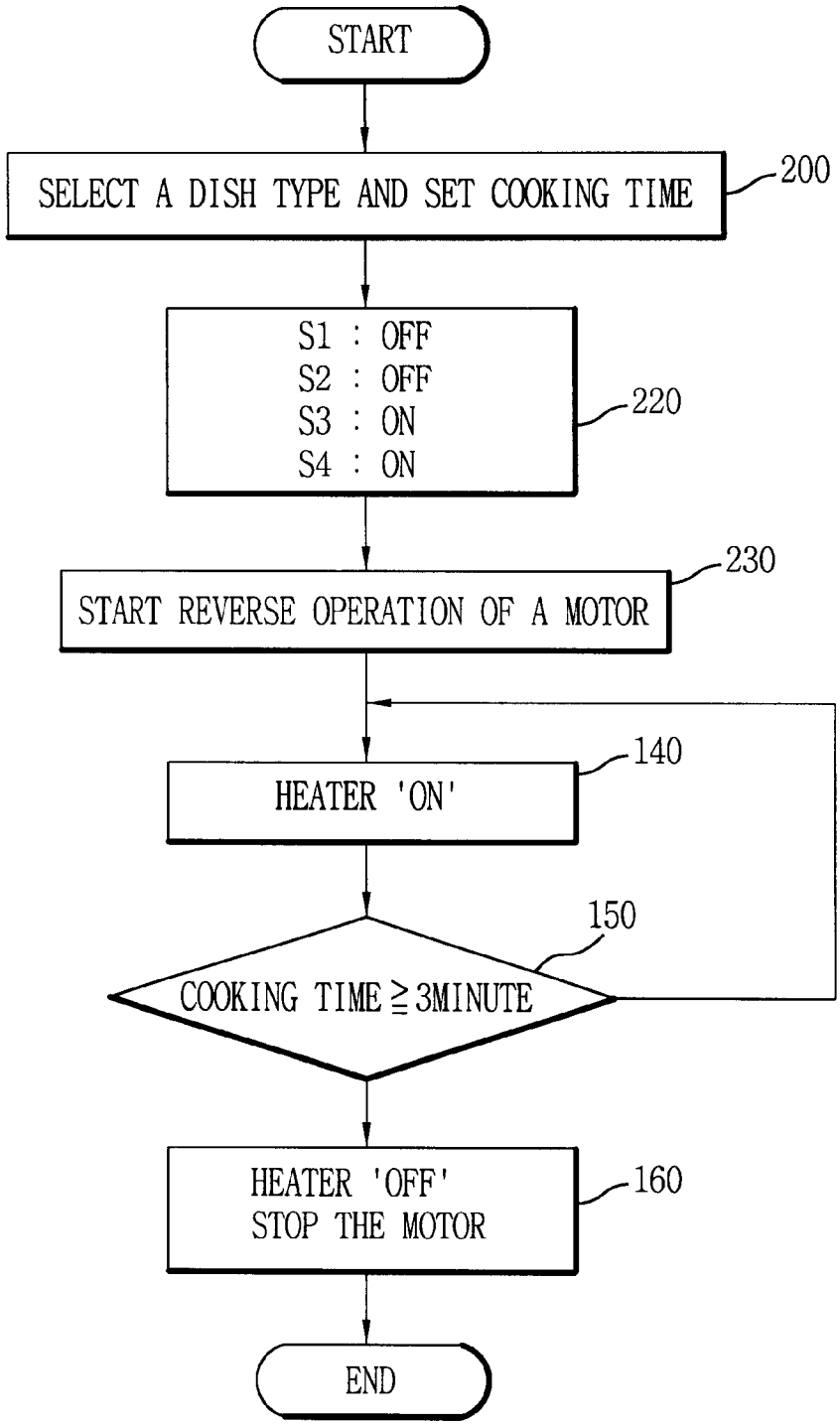
FIG. 6 is a flow chart illustrating the reverse-rotating convection fan control according to the present invention.

FIG. 5 is a flow chart illustrating the control of the convection fan rotating to the direct direction according to the present invention.

First, when a user selects a certain dish, a control unit (not shown) judges whether the selected dish is the first dish required the strong heat power such as the baked fish S100.

The control unit controls the rotating direction of the motor M2 on the basis of the judgement.

In other words, when the direct direction rotation control of the fan 15 is required in order to have the strong heat power, the switches S1, S2 are ON, and the switches S3, S4 are OFF S120.

When the switches S1, S2 are ON, a power applied to the first power line 50*a* is applied to a cathode terminal of the motor M2 through the switch S1, a power applied to the second power line 50*b* is applied to an anode terminal of the motor M2 through the switch S2, accordingly the direct rotation of the motor M2 is started S130.

When the motor M2 starts the direct rotation, the fan 15 is rotated to the direct direction. When the heaters 16*a*, 16*b* are operated under control of the control unit S140, the direct rotation of the fan 15 is performed for the set cooking time set in S100.

In other words, when the fan rotates to the direct direction, the air flow is formed inside of the cavity 22 as depicted in FIG. 3.

In other words, the cold air inside of the cavity 22 is flowed from the second air outlet hole 19 on the side surface to inside of the heater chamber 14, the air is heat-exchanged with the heat generated by the heaters 16*a*, 16*b*, and is provided to the inside of the cavity 22 through the first air outlet hole 18.

Herein, the heat-exchanged air is discharged directly to the upper portion of the heating object 11 placed on the middle.

Accordingly, the heating object 11 directly receives the heat generated by the heater, it is heated with the very strong heat power.

When the heating state is performed for the set cooking time, and the control for informing the end of the set cooking time of the control unit is performed S150, the operation of the motor M2 and heaters 16*a*, 16*b* are stopped S160.

On the contrary, when the user selects the second dish using indirect heating air S200, the switches S3, S4 are On and the switches S1, S2 are OFF by the control unit (not shown) in order to make the fan 15 rotate reversely S220.

When the switches S3, S4 are ON, the power applied to the first power line 50*a* is applied to the anode terminal of the motor M2, the power applied to the second power line 50*b* is applied to the cathode terminal of the motor M2, and the reverse rotation of the motor M2 is performed S230.

When the motor M2 starts the reverse rotation, the fan 15 is rotated reversely.

When the heaters 16*a*, 16*b* are ON under the control of the control unit S140, the reverse rotation of the fan 15 is performed for the set cooking time set in the S200.

In other words, when the fan 15 is rotated reversely, the air flow is formed inside of the cavity 22 as depicted in FIG. 4.

In other words, the cold air is flowed from the first outlet hole 18 to the motor 15, the air is heat-exchanged with the heat generated by the heaters 16*a*, 16*b*, and is provided inside of the cavity 22 through the second air outlet hole 19.

Herein, the high temperature air provided inside of the cavity 22 can heat the heating object 11 overall and evenly from the lower portion because the heated air is flowed from the inner side surface of the cavity 22.

The heating is performed for the set cooking time, and the control for informing the end of the set cooking time of the control unit is performed S150, the operation of the motor M2 and heaters 16*a*, 16*b* are stopped S160.

As described above, the convection fan control method of the microwave oven of the preset invention is capable of performing a rapid heating using a direct heating air to the heating object, at the same time performing even heating using a indirect heating air.

In other words, the preset invention is capable of cooking more delicious dish by controlling discharge direction of the high temperature air discharged to the heating object according to the type of a dish.

As the present invention may be embodied in several forms without departing from the spirit or essential characteristics thereof, it should also be understood that the above-described embodiments are not limited by any of the details of the foregoing description, unless otherwise specified, but rather should be constructed broadly within its sprit and scope as defined in the appended claims, and therefore all changes and modifications that fall within the meets and bounds of the claims, or equivalence of such meets and bounds are therefore intended to be embraced by the appended claims.

What is claimed is:

1. A microwave oven comprising:

a cooking cavity for holding a cooking object to be cooked;

a heater chamber having first air holes and second air holes in communication with the cooking cavity;

an airflow member positioned near the first air holes inside the heater chamber;

a heater positioned near the second air holes inside the heater chamber: and a control device for controlling the airflow member to selectively suck air from the cooking cavity into the heater chamber through the second air holes, or to suck air from the cooking cavity into the heater chamber through the first air holes.

2. The microwave oven of claim 1, wherein said airflow member includes a DC motor capable of rotating in a clockwise or counterclockwise direction.

3. The microwave over of claim 1, wherein said airflow member includes an axial fan.

4. The microwave of claim 1, wherein said first air holes and second air holes comprise a plurality of holes, respectively.

5. The microwave oven of claim 1, further comprising an air guide for guiding an airflow between said airflow member and said heater inside the heater chamber.

6. A microwave oven comprising:

a cavity in which a cooking object is cooked;

a heater chamber mounted in an upper surface of the cavity and having first air holes in the center of the upper surface of the cavity and second air holes in an outer portion of the upper surface of the cavity;

an airflow forming means positioned near the first air holes inside the heater chamber; and a heating means positioned near the second air holes inside the heater chamber:

wherein the airflow forming means makes the air in the cavity be suctioned from the cavity to the heater chamber through the first air holes in the center of the upper surface of the cavity and heated air be discharged from the heater chamber to the cavity through the second air holes in the outer portion of the upper surface of the cavity, or the air in the cavity be suctioned from the cavity to the heater chamber through the second air holes in the outer portion of the upper surface of the cavity and heated air be discharged from the heater chamber to the cavity through the first air holes in the center of the upper surface of the cavity.

7. The microwave oven of claim 6, wherein said airflow forming means includes a DC motor capable of rotating in a clockwise or counterclockwise direction.

8. The microwave oven of claim 6, wherein said airflow forming means includes an axial fan.

9. The microwave oven of claim 6, wherein said first and second air holes comprises a plurality of holes, respectively.

10. The microwave oven of claim 6, further comprising an air guide for guiding airflow positioned between said airflow forming means and said heating means inside the heater chamber.

* * * * *